United States Patent [19]

Janssen et al.

[11] Patent Number: 4,881,616

[45] Date of Patent: Nov. 21, 1989

[54] HEARING AID RETENTION APPARATUS

[76] Inventors: Gwen V. Janssen; Roy C. Rowland, both of 837 NW. 10, Oklahoma City, Okla. 73106

[21] Appl. No.: 335,079

[22] Filed: Apr. 7, 1989

[51] Int. Cl.[4] ..... H04R 25/00

[52] U.S. Cl. ..... 181/129; 181/135; 381/68.7; 381/169; 381/187; 381/205

[58] Field of Search ..... 181/129, 130, 135; 381/68.7, 169, 187, 205

[56] References Cited

U.S. PATENT DOCUMENTS

| | | | |
|---|---|---|---|
| 4,514,598 | 4/1985 | Plice | 381/169 |
| 4,529,058 | 7/1985 | Emery | 181/129 |
| 4,702,345 | 10/1987 | Janssen et al. | 181/129 |

*Primary Examiner*—B. R. Fuller
*Attorney, Agent, or Firm*—Robert K. Rhea

[57] ABSTRACT

In a hearing aid of the type including a battery containing housing normally supported rearwardly of the ear auricle by an elongated hook joining one end of the housing to an ear opening contained ear molding, an elongated tube is secured, at it respective ends, with resilient bands which surround respective end portions of the hearing aid housing and in combination with the hearing aid housing, forms an endless configuration which surrounds the ear auricle at its juncture with the head and positions the hearing aid housing rearwardly of the ear auricle and maintains it in this position by the strand fitting snugly adjacent the user's head and forwardly of the tragus.

5 Claims, 1 Drawing Sheet

HEARING AID RETENTION APPARATUS

BACKGROUND OF THE INVENTION

1. Field of the invention

This invention relates generally to hearing aid accessories and more particularly to an apparatus which supplements the normal hearing aid ear engaging hook, or the like.

2. Description of the prior art

It is well known by persons who wear or are acquainted with hearing aids that conventionally they are supported on the ear by means of ear molds and ear hooks in order to securely hold the hearing aid in a proper position for comfort and hearing.

It is usually necessary to alter the size and/or the shape of the ear mold. This may include forming or changing ear hooks to a special shape or size or forming a flexible ear hook. The hearing aid housing, in some examples, may also need to be custom shaped for fitting. These several limitations are objectionable and it is therefore believed that, some improvement needs to be provided in retention hearing aid devices as used on the ear.

The most pertinent prior patent is believed to be our U.S. Pat. No. 4,702,345. This patent discloses an endless strand-like ring having a pair of bands loosely surrounding a toric portion of the ring. The bands are engageable with the respective end portions of a hearing aid housing and the endless strand-like ring is adapted to surround the ear auricle adjacent the head thus supporting the hearing aid in a comfortable position on the user's ear and being sure that it is maintained in place. While that patent discloses a satisfactorily operating device it has the limitation that a number of different sizes of rings must be provided, for example, for an adult or for a child. It seems obvious that an adult size ring would not be satisfactorily adaptable for use by a child.

This invention provides a generally universally acceptable apparatus which may be used on any size ear or with most any size hearing aid housing to be maintained on or adjacent the ear.

SUMMARY OF THE INVENTION

An elongated strand-like member is provided, at its respective ends, with a flexible wall sleeve having a wall aperture snugly receiving one end portion of the flexible member. The sleeve is dimensioned for resiliently surrounding one end portion of a hearing aid housing. The sleeves are secured to or formed with the elongated strand member in a manner such that, in combination with the hearing aid housing, surrounded at its respective end portions, by the sleeves, forms an endless ringlike configuration which surrounds the ear auricle between the user's head and ear to maintain the hearing aid in position rearwardly of the ear.

The principal object of this invention is to provide a hearing aid support which is or may be adjusted for any size individual ear and may be easily positioned around the ear in hearing aid supporting position which is simple in design and inexpensive to manufacture and relatively rugged in construction and has a long useful life.

DESCRIPTION OF THE PREFERRED EMBODIMENTS

Figure 2:
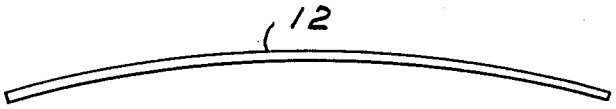
FIG. 2 is an elevational view of the elongated strand, per se.
Figure 3:
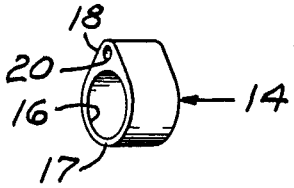
FIG. 3 is a perspective view of one of the strand end portion sleeve.
Figure 1:
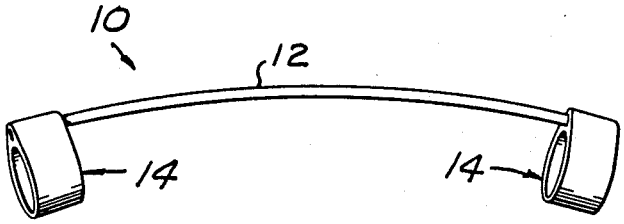
FIG. 1 is a perspective view of the assembly.
Figure 4:
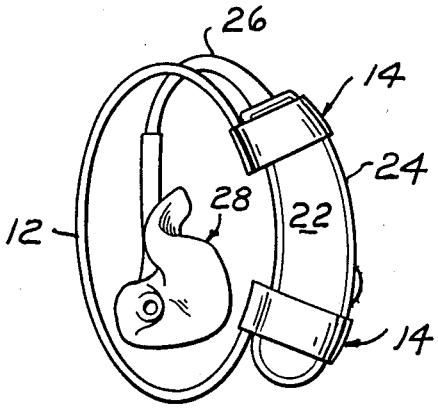
FIG. 4 is a perspective view of the device in operative position supporting a hearing aid device having an ear mold attached to the hook thereof.

Like characters of reference designate like parts in those figures of the drawings in which they occur.

In the drawings:

The reference numeral 10 indicates the device, as a whole, comprising an elongated flexible strand-like member 12 secured, at its respective ends, with a pair of endless bands or sleeves 14. The strand 12 may be a tube or a length of monofilament plastic with its length determined by the custom fitting of an ear, as hereinafter explained.

Since the endless sleeves 14 are identical, only one is described in detail. The sleeve 14 is substantially band-like in appearance having a central bore or opening 16 defined by a relatively thin flexible wall 17 throughout most of its major diameter. One portion of the wall is outwardly thickened, as at 18, and apertured parallel with the longitudinal axis of the opening 16, as at 20, on a diameter snugly receiving one end portion of the strand 12. The strand end portions are anchored to each of the of the sleeves 14, as by gluing. Obviously the strand and sleeves may be formed in unitary fashion, if desired.

The reference numeral 22 indicates a conventional hearing aid having a supporting ear hook 26 connected with one of its ends which in turn is connected with a custom fitted ear mold 28.

In carrying out the invention, the strand 12 is formed or cut to a length determined by the circumference of the auricle of the user's ear to be fitted. With each sleeve of the pair of sleeves 14 secured to respective end portions of the strand 12, one of the sleeves is placed in snug surrounding relation on one end portion of the hearing aid housing 24 and the other sleeve 14 similarly surrounds the other end portion of the housing 24. Some adjustment of the length of the strand 12 may be accomplished by moving the sleeves toward or away from each other on the housing 24 to customize its fit on the user's ear. This degree of movement, of course, is limited by the longitudinal dimension of the housing. An endless effect of the strand 12 is achieved, combination with the housing 24, by surrounding the user's ear between the user's head and the ear helix, between the user's head and over the ear forwardly of the tragus. The housing 24 is thus supported on the inner surface of the ear helix and the ear mold 28 is then received by the fossa or ear cavity.

Obviously the invention is susceptible to changes or alterations without defeating its practicability. Therefore, we do not wish to be confined to the preferred embodiment shown in the drawings and described herein.

We claim:

1. In a normally ear auricle supported hearing aid having an elongated housing arcuately curved longitudinally and adapted to be supported generally longitudinally upright in a space between the auricle and head of a user adjacent a rearward upper limit of a juncture of the ear auricle with the head by a conductor member extending, in inverted generally J-shaped hook fashion across a forward and upper limit of an ear helix juncture with the head, between an upper limit of the housing and a hearing aid ear mold disposed in an ear fossa, the improvement comprising:

an elongated flexible member snugly surrounding the major forward, upper and lower portion of the ear auricle at the juncture with the head of the user's head; and, resilient means attached to said flexible member for connecting the end portions of said flexible member with respective end portions of said hearing aid housing.

2. The ear auricle supported hearing aid according to claim 1 in which said resilient means includes:

a pair of sleeves surrounding the end portions of said housing.

3. The ear auricle supported hearing aid according to claim 2 in which, the length of each sleeve of said pair of sleeves is substantially greater than its wall thickness thereof and a circumferential portion of said wall is thickened in an outward direction and provided with an aperture therethrough snugly receiving one end portion of said elongated flexible member.

4. The ear auricle supported hearing aid according to claim 3 in which the aperture in said sleeve wall portion is parallel with the longitudinal axis of said sleeve.

5. In a normally ear auricle supported hearing aid having an elongated housing arcuately curved longitudinally and adapted to be supported generally longitudinally upright in a space between the auricle and a head of a user adjacent a rearward upper limit of a juncture of the ear auricle with the head by a conductor member extending, in inverted generally J-shaped hook fashion across a forward and upper limit of an ear helix juncture with the head, between an upper limit of the housing and a hearing aid ear mold disposed in an ear fossa, the improvement comprising:

an elongated flexible strand snugly surrounding a major forward, upper and lower portion of the ear auricle at the juncture with the head of the user; and, resilient means including a pair of sleeves connected to respective end portions of said strand and surrounding respective end portions of said hearing aid housing.

* * * * *